US011220842B2

(12) United States Patent
Liu et al.

(10) Patent No.: US 11,220,842 B2
(45) Date of Patent: Jan. 11, 2022

(54) ALARMING CODE LOCK

(71) Applicant: GMT INTELLIGENT ELECTRONIC TECHNOLOGY (KUNSHAN) CO., LTD., Kunshan (CN)

(72) Inventors: Mingxia Liu, Kunshan (CN); Yanwen Liu, Kunshan (CN)

(73) Assignee: GMT INTELLIGENT ELECTRONIC TECHNOLOGY (KUNSHAN) CO., LTD., Kunshan (CN)

( * ) Notice: Subject to any disclaimer, the term of this patent is extended or adjusted under 35 U.S.C. 154(b) by 56 days.

(21) Appl. No.: 16/870,913

(22) Filed: May 9, 2020

(65) Prior Publication Data

US 2020/0370335 A1 Nov. 26, 2020

(30) Foreign Application Priority Data

May 20, 2019 (CN) ..... 201920722771.X

(51) Int. Cl.
*E05B 45/06* (2006.01)
*E05B 45/00* (2006.01)

(52) U.S. Cl.
CPC ..... *E05B 45/061* (2013.01); *E05B 45/005* (2013.01)

(58) Field of Classification Search
CPC ..... E05B 45/061; E05B 45/005
USPC ..... 70/219
See application file for complete search history.

(56) References Cited

U.S. PATENT DOCUMENTS 5,587,702 A * 12/1996 Chadfield ..... E05B 45/005 340/542
5,727,405 A * 3/1998 Cromwell ..... E05B 45/005 340/427
5,786,759 A * 7/1998 Ling ..... B62J 3/00 340/542
5,836,002 A * 11/1998 Morstein ..... B62H 5/00 340/568.1
6,420,971 B1 * 7/2002 Leek ..... E05B 39/04 340/542
2002/0171550 A1 * 11/2002 Hirose ..... E05B 47/0603 340/572.9
2008/0066502 A1 * 3/2008 Sheehan ..... E05B 45/005 70/49
2008/0316028 A1 * 12/2008 Conti ..... E05B 73/0029 340/568.2
2009/0303046 A1 * 12/2009 Eckert ..... E05B 45/005 340/568.4

(Continued)

*Primary Examiner* — Kerri L McNally

(57) ABSTRACT

The present disclosure provides an alarming code lock, including a lock head and a steel wire rope. A warning device, a circuit board, and a trigger switch are disposed inside the lock head. The warning device and the trigger switch are electrically connected with the circuit board. One end of the steel wire rope is fixedly connected with the lock head and is electrically connected with the circuit board. A plug is disposed on another end of the steel wire rope. The plug is inserted into the lock head and then makes contact with the trigger switch. The steel wire rope and the circuit board form a protection circuit, and the warning device is configured to raise an alarm when the plug keeps in contact with the trigger switch and the protection circuit is disconnected.

7 Claims, 3 Drawing Sheets

(56) References Cited

U.S. PATENT DOCUMENTS

| | | | | |
|---|---|---|---|---|
| 2011/0260867 | A1* | 10/2011 | McCracken | E05B 67/003 340/568.4 |
| 2012/0227446 | A1* | 9/2012 | Shute | E05B 73/0029 70/15 |
| 2013/0147625 | A1* | 6/2013 | Sayegh | G08B 13/2451 340/568.2 |
| 2014/0109631 | A1* | 4/2014 | Asquith | E05B 39/005 70/15 |
| 2018/0171665 | A1* | 6/2018 | Anderson | E05B 39/005 |

* cited by examiner

ALARMING CODE LOCK

TECHNICAL FIELD

The present disclosure relates to a technical filed of coded locks, in particular to an alarming code lock.

BACKGROUND

Conventional coded locks include steel wire ropes and lock heads, and are mainly applied to zippers on luggage cases, backpacks, etc, which mainly play an anti-theft role. The coded locks do not remind to users at once if criminals use abnormal ways to unlock the locks, which will easily cause the users' items to be lost. Since steel wire ropes of coded locks cannot effectively prevent shearing, it is easy for criminals to break the steel wire ropes of the coded locks, thereby stealing items.

Therefore, there needs an alarming code lock to solve the above-mentioned technical problems.

SUMMARY

An object of the present disclosure is to provide an alarming code lock raising an alarm when a steel wire rope of the alarming code lock is violently damaged to give prompts to users.

In order to achieve the object, a technical scheme below is adopted by the present disclosure.

The present disclosure provides an alarming code lock, including a lock head. A warning device, a circuit board, and a trigger switch are disposed inside the lock head. The warning device and the trigger switch are electrically connected with the circuit board. The alarming code lock further includes a steel wire rope. One end of the steel wire rope is fixedly connected with the lock head and is electrically connected with the circuit board. A plug is disposed on another end of the steel wire rope. The plug is inserted into the lock head and then makes contact with the trigger switch. The steel wire rope and the circuit board form a protection circuit, and the warning device is configured to raise an alarm when the plug keeps in contact with the trigger switch and the protection circuit is disconnected.

Furthermore, an metal elastic piece is disposed inside the lock head, and the metal elastic piece is electrically connected with the circuit board. When the plug is inserted into the lock head, the plug abuts against the metal elastic piece.

Furthermore, a central shaft and a plurality of code rotating rings sleeved on the central shaft are disposed on the lock head.

Furthermore, one end of the central shaft is exposed on one side of the lock head, the central shaft is slidably connected with the lock head, and the central shaft slides along with an axial direction of the central shaft.

Furthermore, the alarming code lock further includes elastic members. A limiting groove is disposed on the plug in a circumferential. A limiting hole for the plug to insert in is disposed on the central shaft. When the plug inserts into the lock head, the elastic members drive the central shaft to slide outwards, so that an inner wall of the limiting hole abuts against a groove bottom of the limiting groove.

Furthermore, the warning device includes a buzzer and/or an alann indicator lamp.

Furthermore, the one end of the steel wire rope connects with the circuit board through a connecting wire.

Furthermore, the lock head includes an upper shell and a lower shell, the upper shell and the lower shell are fixedly connected. The warning device, the circuit board and the trigger switch are disposed inside a containing space formed by the upper shell and the lower shell.

Beneficial effects of the present disclosure are as followings: when the plug and the trigger switch are kept in contact and the protection circuit is disconnected, the warning device raises the alarm. That is, after the plug is inserted into the lock head, the warning device is in a to-be-alarm state. When the steel wire rope is cut off or broken by other violent ways, the circuit board detects that the protection circuit is disconnected, and the warning device is controlled to raise an alarm to prompt the users. Due to presence of the trigger switch, when the plug is pulled out from the lock head, the protection circuit is disconnected, and the circuit board detects that the protection circuit is disconnected. However, in this situation, the warning device is in a closed state, the circuit board cannot control the warning device, so that the alarm is not raised. The presence of the trigger switch prevents the alarming code lock from raising the alarm without reason when the plug is not inserted into the lock head.

Figure 1:
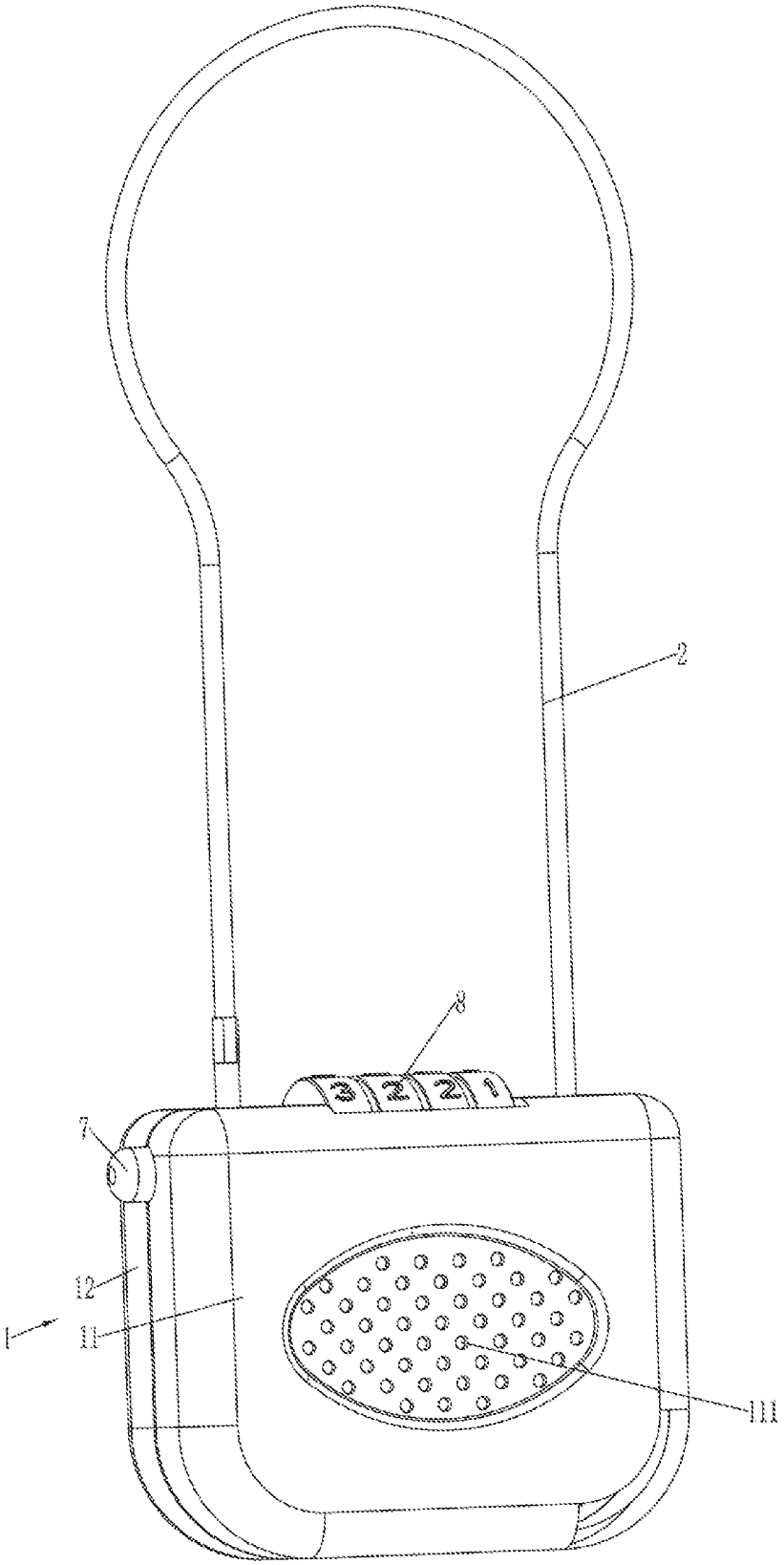
FIG. 1 is a schematic structural diagram of an alarming code lock of the present disclosure.

In the drawings: (1) lock head; (11) upper shell; (111) light-transmitting hole; (12) lower shell; (2) steel wire rope; (21) plug; (22) fixed head; (3) warning device; (31) buzzer; (32) alarm indicator lamp; (4) circuit board; (41) connecting wire; (5) trigger switch; (6) metal elastic piece; (7) central shaft; (71) limiting hole; (8) code rotating ring; (9) elastic member.

DETAILED DESCRIPTION

In order make objectives, technical solutions, and advantages of embodiments of the present disclosure more apparent, the embodiments of the present disclosure are clearly and completely described below by reference to accompanying drawings of the embodiments of the present disclosure. Obviously, the described embodiments are parts of the present disclosure, not all embodiments. Components of the embodiments of the present disclosure, which are generally described and illustrated in the accompanying drawings herein, may be disposed and designed in a variety of different configurations.

Thus, following detailed descriptions of the embodiments of the present disclosure provided in the drawings is not intended to limit the scope of the present disclosure, but is merely representative of selected embodiments of the present disclosure. Based on the embodiments of the present disclosure, those of ordinary skill in the art who obtain other all embodiments without making any inventive faculty, fall within the scope of the present invention.

It should be noted that similar reference numerals and letters indicate similar items in the accompanying drawings. Thus, once an item is defined in one drawings, then it is not required to be further defined and explained in subsequent drawings.

It should be understood in the description of the present disclosure that terms such as "upper", "lower", "left", "right", "vertical", "horizontal", "top", "bottom", "inner", "outer", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure. In addition, the terms such as "first" and "second" are only used for the purpose of description, rather than being understood to indicate or imply relative importance or hint the number of indicated technical features. Thus, the feature limited by "first" and "second" can explicitly or implied comprise one or more features. In the description of the present disclosure, the meaning of "a plurality of" is two or more unless otherwise specified.

It should be noted in the description of the present disclosure that, unless otherwise regulated and defined, terms such as "installation," "connected," and "connecting" shall be understood in broad sense, and for example, may refer to fixed connecting or detachable connecting or integral connecting; may refer to mechanical connecting or electrical connecting; For those of ordinary skill in the art, the meanings of the above terms in the present disclosure may be understood according to concrete conditions In the present disclosure, unless expressly specified and defined otherwise, a first feature "on" or "under" a second feature may include both the first and second features being in direct contact, and may also include the first and second features not being in direct contact but with additional features therebetween. Moreover, the first feature "over", "above" and "upper" of the second feature include that the first feature is directly above and obliquely above the second feature, or simply indicates that the first feature level is higher than the second feature. The first features "under", "below", "and "lower" of the second feature include that the first feature is directly below and obliquely below the second feature, or simply indicates that the first feature level is less than the second feature.

Embodiments of the present disclosure are described in detail below, examples of which are illustrated in the accompanying drawings. Moreover, same or similar reference numerals represent same or similar elements or elements having the same or similar functionality throughout. The embodiments described below by reference to the accompanying drawings are exemplary and are used merely to explain the present disclosure and are not to be construed as limiting the disclosure.

Figure 2:
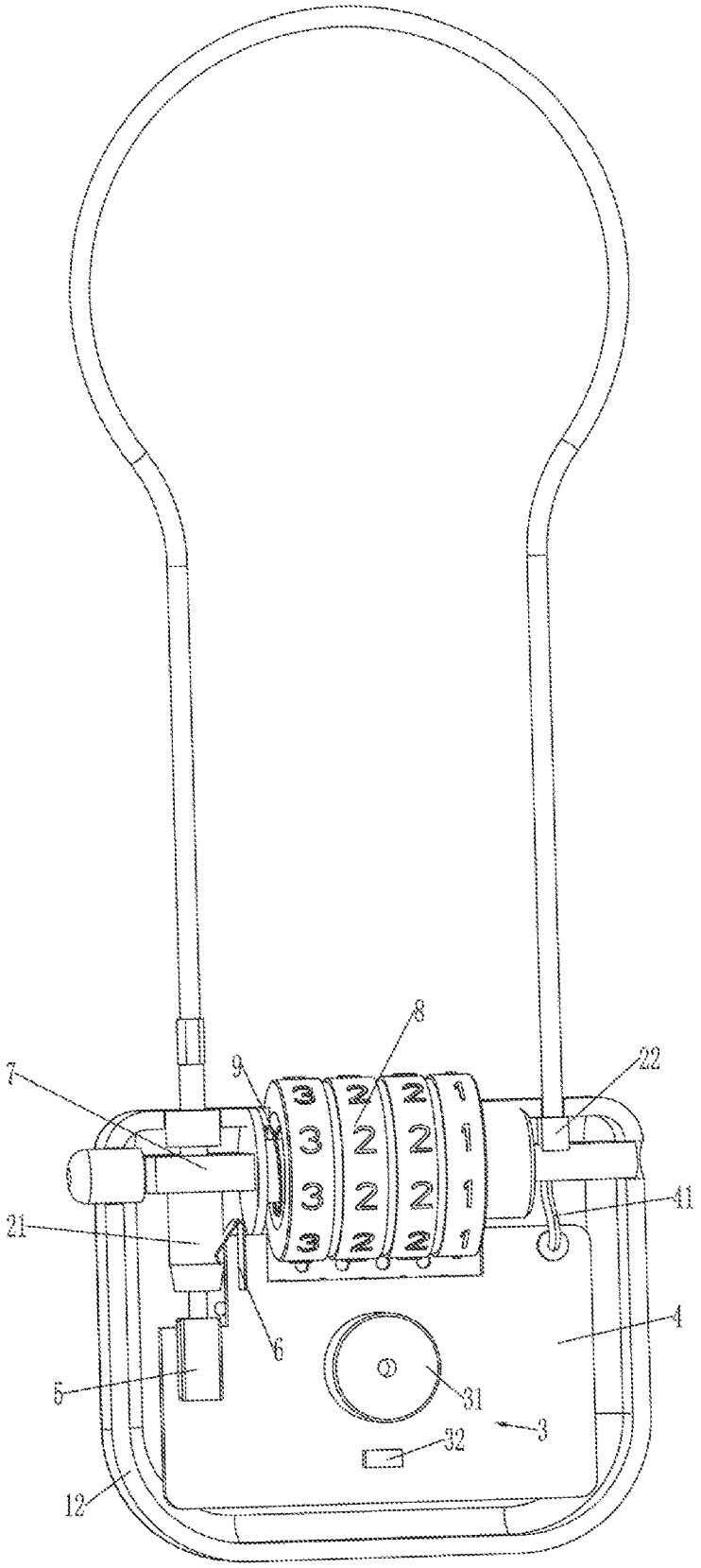
FIG. 2 is a schematic structural diagram of the alarming code lock of the present disclosure where a shell body is removed.
Figure 3:
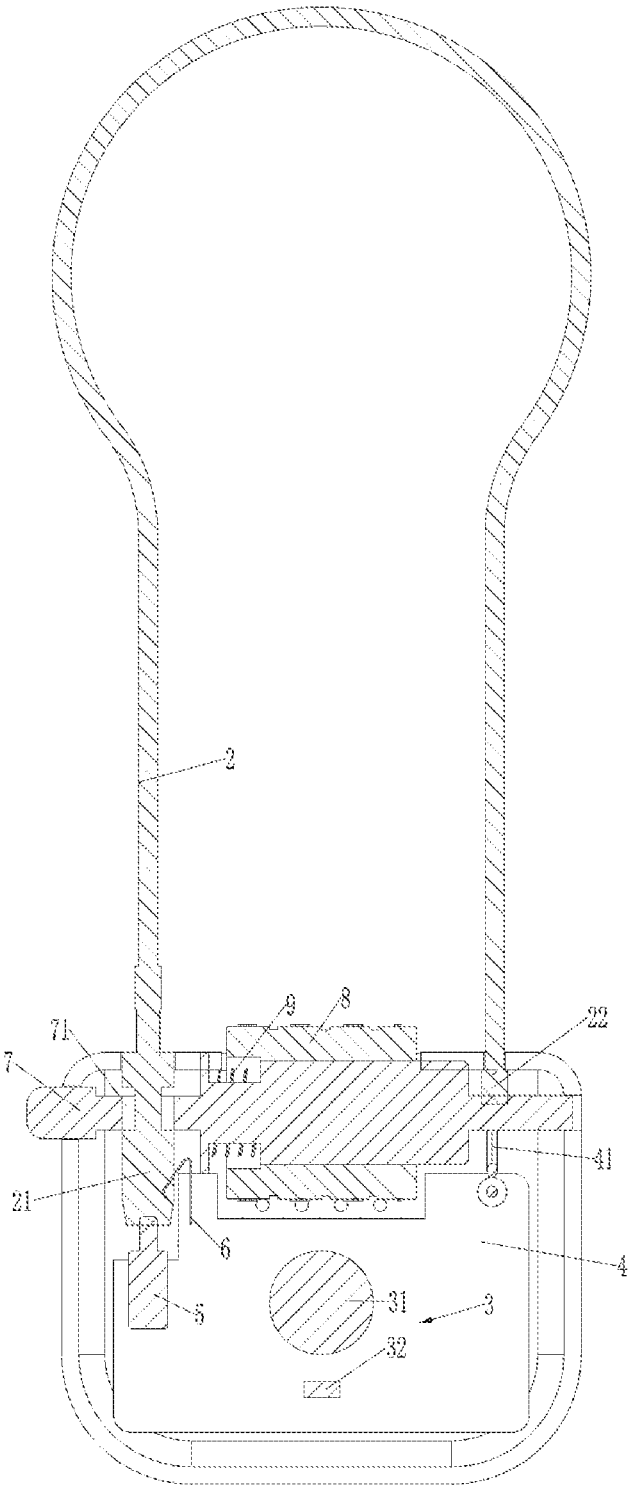
FIG. 3 is a cross sectional diagram of the alarming code lock of the present disclosure.

As shown in FIGS. 1-3, the present disclosure provides an alarming code lock, including a lock head 1 and a steel wire rope 2. A warning device 3, a circuit board 4, and a trigger switch 5 are disposed inside the lock head 1. The warning device 3 and the trigger switch 5 are electrically connected with the circuit board 4. Two ends of the steel sire rope 2 are respectively an inserting end and a fixing end. A plug 21 is disposed on the inserting end, and a fixing head 22 is disposed on the fixing end. The fixing head 22 is fixed inside the lock head 1, and the fixing head 22 is connected with the circuit board 4 through a connecting wire 41.

The plug 21 is inserted into the lock head 1 and then communicates with the circuit board 4. The steel wire rope 2 and the circuit board 4 form a protection circuit. Specifically, an metal elastic piece 6 is disposed inside the lock head 1, and the metal elastic piece 6 is electrically connected with the circuit board 4. When the plug 21 is inserted into the lock head 1, the plug 21 abuts against the metal elastic piece 6 to make the plug 21 communicate with the circuit board 4, so that the steel wire rope 2 and the circuit board 4 form a protection circuit.

The plug 21 is inserted into the lock head 1 and then contacts the trigger switch 5 to make the warning device 3 be in a to-be-alarm state. When the protection circuit is accidentally disconnected, the warning device 3 raises an alarm. The warning device 3 includes a buzzer 31 and/or an alarm indicator lamp 32, and the alarm indicator lamp 32 is an LED lamp which emits red light. When the protection circuit is accidentally disconnected, the warning device 3 raises a high decibel buzz and red light alarm to prompt users. A plurality of light-transmitting holes 111 are disposed on the lock head 1, which make the red light emitted by the alarm indicator lamp 32 displayed. The high decibel buzz raised by the buzzer 31 is further transmitted out of the light-transmitting holes 111.

Due to presence of the trigger switch 5, when the plug 21 is pulled out from the lock head 1, the protection circuit is disconnected, and the circuit board 4 detects that the protection circuit is disconnected. However, the warning device 3 is in a closed state, the circuit board 4 cannot control the warning device 3, so that the alarm is not raised. Only when the steel wire rope 2 is cut off or broken by other violent ways, the circuit board 4 detects that the protection circuit is disconnected, so that the warning device 3 is controlled to raise the alarm to prompt the users. The presence of the trigger switch 5 prevents the alarming code lock from raising the alarm without any reason when the plug 21 is not inserted into the lock head 1.

A central shaft 7 and a plurality of code rotating rings 8 sleeved on the central shaft 7 are disposed on the lock head. In one embodiment, a number of the code rotating rings 8 is four, and numbers or letters are disposed on the code rotating rings 8. The code rotating ring 8 is partially exposed on the lock head 1, so that the corresponding numbers or letters can be exposed out. According to the embodiment of the present disclosure, the numbers are disposed on the code rotating rings 8, so that the numbers on the code rotating ring 8 are gradually exposed out by rotating the code rotating rings 8.

A limiting groove is disposed on of the plug 21 in a circumferential direction, a limiting hole 71 is disposed on the central shaft 7, and the plug 21 passes through the limiting hole 71. One end of the central shaft 7 is exposed on one side of the lock head 1, the central shaft 7 is slidably connected with the lock head 1, and the central shaft 7 slides along with an axial direction of the central shaft 7. Elastic members 9 are disposed inside the lock head 1, and the elastic members 9 make an exposed part of the central shaft 7 to be exposed on the plug 1. When the plug 21 of the steel wire rope 2 passes through the limiting hole 71, the central shaft 7 needs to slide inwards. After the plug 21 is inserted into the lock head 1, the limiting groove is located at the limiting hole 71, the central shaft 7 slides outwards driving by the elastic piece 9, an inner wall of the limiting hole 71 abuts against a groove bottom of the limiting groove, and the central shaft 7 limits the limiting groove of the plug 21 so that the plug 21 cannot be pulled out without pressing the central shaft 7 inwards. Only when all the code rotating rings 8 are rotated to an unlocking position, the exposed part of the central shaft 7 is pressed to slide the central shaft 7 into the lock head 1, so that the central shaft 7 no longer limits the plug 21, and the plug 21 is pulled out from the lock head 1.

The lock head 1 includes an upper shell 11 and a lower shell 12, and the upper shell 11 and the lower shell 12 are fixedly connected. The warning device 3, the circuit board 4 and the trigger switch 5 are disposed inside a containing space formed by the upper shell 11 and the lower shell 12. The code rotating rings 8 are partially accommodated in the containing space, parts of the code rotating rings 8 are exposed above the lock head 1, and the light-transmitting holes 111 are disposed on the upper shell 11.

Obviously, the foregoing embodiments of the present disclosure are merely examples for clearly explaining the present disclosure, and are not intended to limit the embodiments of the present disclosure. It is apparent to one of ordinary skilled in the art that other different forms of changes or variations can be made on the basis of the above description. Not all embodiments have requirements and are capable to be exhaustive. All modifications, equivalents, and improvements made within the spirit and principles of the present disclosure are intended to be included within the scope of the claims appended hereto.

What is claimed is:

1. An alarming code lock, comprising:

a lock head (1); wherein a warning device (3), a circuit board (4), and a trigger switch (5) are disposed inside the lock head (1); the warning device (3) and the trigger switch (5) are electrically connected with the circuit board (4);

a steel wire rope (2); wherein one end of the steel wire rope (2) is fixedly connected with the lock head (1) and is electrically connected with the circuit board (4); a plug (21) is disposed on another end of the steel wire rope (2); the plug (21) is inserted into the lock head (1) and then contacts the trigger switch (5); the steel wire rope (2) and the circuit board (4) form a protection circuit; and the warning device (3) is configured to raise an alarm when the plug (21) keeps in contact with the trigger switch (5) and the protection circuit is disconnected;

wherein a metal elastic piece (6) is disposed inside the lock head (1), and the metal elastic piece (6) is electrically connected with the circuit board (4); when the plug (21) is inserted into the lock head (1), the plug (21) abuts against the metal elastic piece (6).

2. The alarming code lock according to claim 1, wherein a central shaft (7) and a plurality of code rotating rings (8) sleeved on the central shaft (7) are disposed on the lock head (1).

3. The alarming code lock according to claim 2, wherein one end of the central shaft (7) is exposed on one side of the lock head (1), the central shaft (7) is slidably connected with the lock head (1), and the central shaft (7) slides along an axial direction of the central shaft (7).

4. The alarming code lock according to claim 3, wherein the alarming code lock further comprises elastic members (9); a limiting groove is disposed on the plug (21) in a circumferential direction; a limiting hole (71) for the plug (21) to insert in is disposed on the central shaft (7); when the plug (21) inserts into the lock head (1), the elastic members (9) drive the central shaft (7) to slide outwards, so that an inner wall of the limiting hole (71) abuts against a groove bottom of the limiting groove.

5. The alarming code lock according to claim 1, wherein the warning device (3) comprises a buzzer (31) and/or an alarm indicator lamp (32).

6. The alarming code lock according to claim 1, wherein the one end of the steel wire rope (2) connects with the circuit board (4) through a connecting wire (41).

7. The alarming code lock according to claim 1, wherein the lock head (1) comprises an upper shell (11) and a lower shell (12), the upper shell (11) and the lower shell (12) are fixedly connected; the warning device (3), the circuit board (4), and the trigger switch (5) are disposed inside a containing space formed by the upper shell (11) and the lower shell (12).

* * * * *